US006557314B2

(12) United States Patent
Shelton

(10) Patent No.: US 6,557,314 B2
(45) Date of Patent: May 6, 2003

(54) ATHLETIC FLOORING SUBSTRUCTURE

(76) Inventor: Floyd Shelton, 1617 Sunnyvale La., Wausau, WI (US) 54401

( * ) Notice: Subject to any disclaimer, the term of this patent is extended or adjusted under 35 U.S.C. 154(b) by 0 days.

(21) Appl. No.: 09/883,453

(22) Filed: Jun. 18, 2001

(65) Prior Publication Data

US 2002/0189184 A1 Dec. 19, 2002

(51) Int. Cl.[7] ..... E04B 9/00
(52) U.S. Cl. ..... 52/480; 52/403.1
(58) Field of Search ..... 52/480, 403.1, 52/302.1

(56) References Cited

U.S. PATENT DOCUMENTS 4,007,571 A * 2/1977 Marchello et al. ..... 52/480
4,854,099 A * 8/1989 Kristoffersen ..... 52/480
4,879,857 A * 11/1989 Peterson et al. ..... 52/403.1
5,388,380 A * 2/1995 Neise ..... 52/403.1
5,412,917 A * 5/1995 Shelton ..... 52/403.1
6,032,425 A * 3/2000 Gugliotti et al. ..... 52/480
6,367,217 B1 * 4/2002 Niese et al. ..... 52/480
6,363,675 B1 * 8/2002 Shelton ..... 52/403.1

* cited by examiner

*Primary Examiner*—Carl D. Friedman
*Assistant Examiner*—Nahid Amiri
(74) *Attorney, Agent, or Firm*—Russell L. Johnson, Patent Agent

(57) ABSTRACT

A ladder-shaped subassembly for use in assembling a subfloor for an athletic floor that is anchored, resilient, ventilatable, and DIN certifiable. Long nailing strips form the long members of the ladder-shape while shorter transverse anchor strips secured below the long members form the rung members of the ladder shape. The anchor strips have resilient pads secured to their lower face. The ladder-shaped subassemblies are positioned on a base so that the long members are abutting and the long members of the subassemblies are spaced apart from each other approximately the same distance as they are spaced from each other on the subassembly thereby creating an open channel through which ventilating air can flow between the flooring above the subassemblies and the base below the subassemblies. Anchors engage the anchor strips so as to permit the downward flexure of the floor but limit the upward rebound of the floor.

7 Claims, 4 Drawing Sheets

FIG 6
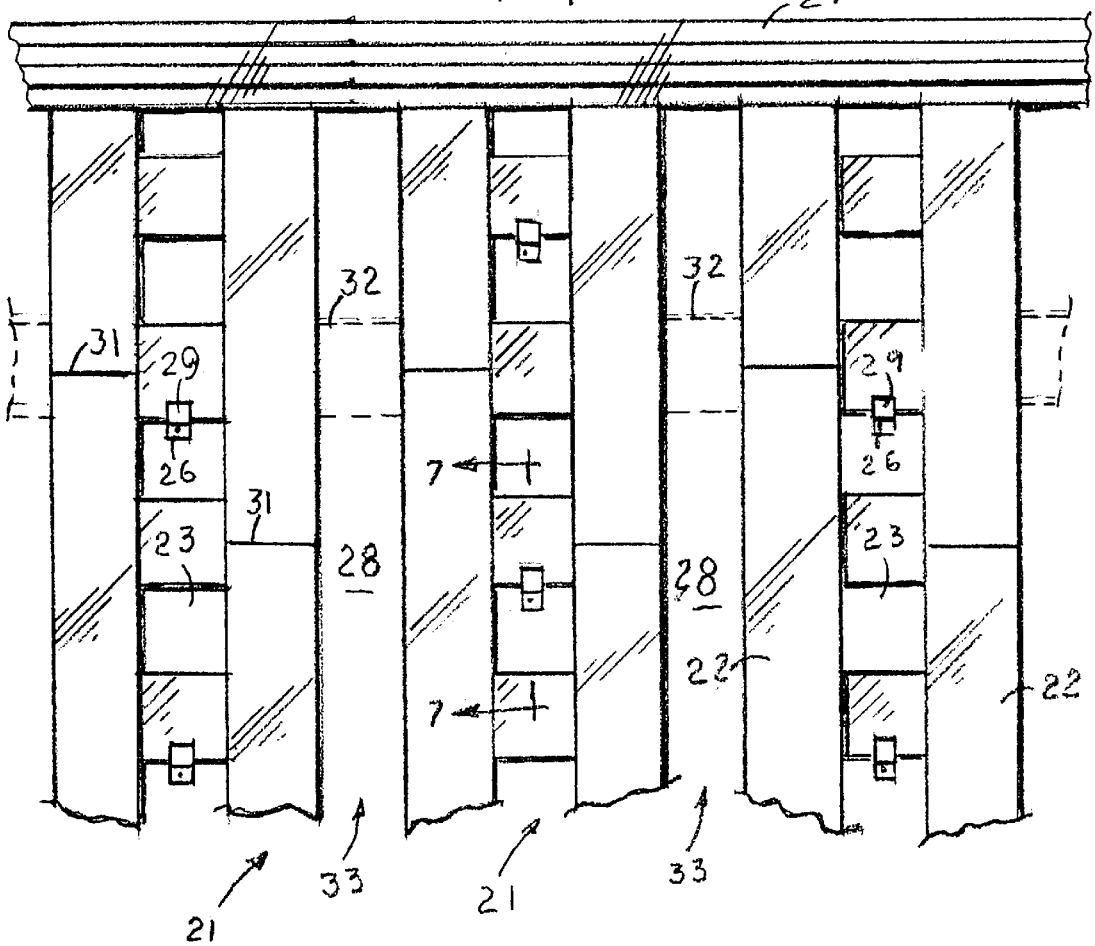
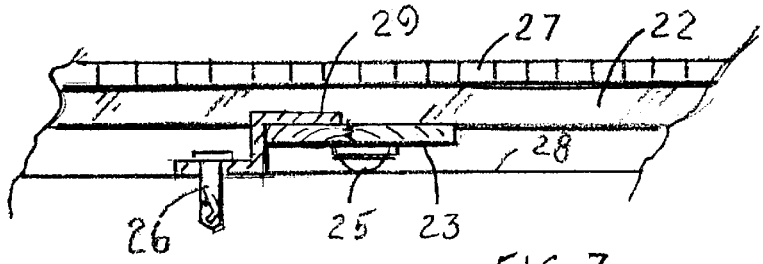
FIG. 7

ATHLETIC FLOORING SUBSTRUCTURE

BACKGROUND OF THE INVENTION

1. Field of the Invention

This invention relates to an improvement in substructures for athletic flooring systems.

More particularly, this invention relates to substructures for anchored resilient athletic systems that are ventilatable and DIN certifiable.

Still more particularly, this invention relates to the substructures described above wherein the substructure is built up of prefabricated ladder-shaped subassemblies that are interconnected and anchored to a base so as to form a rapidly installable low cost subfloor for athletic flooring systems.

Still more particularly, this invention relates to the substructures described above wherein the ladder-shaped subassemblies are positioned on a base so that the long members of one subassembly are spaced apart from and parallel to the long members of an adjacent subassembly so that approximately one fourth of the base area is not covered by the subassemblies.

2. Prior Art

The athletic flooring art abounds with inventions and innovations that have advanced the athletic flooring technologies in the last two decades. In the 1980s standards for some of the measurable physical properties of such flooring systems were developed and published in a set of standards that became well known in the industry as the DIN standards. Flooring systems that meet these standards are referred to as DIN certifiable.

The instant inventor's U.S. Pat. No. 5,412,917 (917) which is hereby incorporated herein by reference, teaches a Fixed Resilient Sleeper Athletic Flooring System. The flooring system of the 917 patent is DIN certifiable and the DIN 18032 Part 2 requirements are disclosed therein along with a brief discussion of the categories used and the nature of the data gathered for DIN certification. DIN certification has become well known in the flooring art and the disclosures of the 917 patent will not be reproduced herein.

The 917 patent teaches a sleeper that is in the order of two inches thick by three inches wide and is provided with transverse saw kerfs to impart flexibility to the sleeper and the sleeper is provided with counterbored holes to receive the sleeved anchors with sufficient clearance for the sleeper to flex downward without the top of the anchor engaging overlaying subfloor. The sleeper of the 917 patent can serve to provide the resilience and flexibility needed in a floor to obtain DIN certification. The sleeper of the 917 patent works well for its intended purposes but its use requires a significant amount of labor and materials in its fabrication and installation.

The instant inventor's U.S. Pat. No. 5,526,621 (621) teaches a Ventilated Athletic Flooring System. The capacity to ventilate a subflooring structure is desirable in situations where moisture may find its way beneath an athletic floor with the potential to damage the athletic floor.

The (621) patent teaches the use of a humidistat and an air mover to ventilate a subflooring structure. The improved subfloor of this invention provides a superior open subflooring structure that promotes the flow of drying air into and out of the subflooring structures.

U.S. Pat. No. 5,581,965 (965) to Jargenson et al. teaches the use of prefabricated subflooring modules. Each module is formed of cross laid joists having resilient members interposed between the joists at their intersections. The flooring structure of the 965 patent is large and requires significant amounts of labor and materials for its fabrication and installation. The 965 patents teaches modules joined to each other on all sides.

The prior art abounds in recent patents that employ some of the means used in the subflooring structures of this invention. However, viewed collectively, they cannot provide the superior quality subfloor obtainable with this invention at the low cost of materials and labor obtainable with this invention.

BRIEF SUMMARY OF THE INVENTION

The invention is for a subflooring system for athletic floors wherein the subfloor is assembled of a multiplicity of ladder-shaped subassemblies wherein each subassembly has two long boards as top nailing strips, and a multiplicity of cross boards secured under the long boards as anchor strips and resilient pads secured under the cross boards. The subfloor is assembled using a multiplicity of the subflooring subassemblies wherein the long boards of the subassembly are joined end to end and the subassemblies are laid so that their long boards are parallel and uniformly spaced apart. The subassemblies are maintained in position by means of anchors, which limit the horizontal displacement of the subfloor assembly while permitting downward flexure of the floor on the pads and at the same time restraining the upward rebound of the floor.

BRIEF DESCRIPTION OF THE DRAWINGS

FIG. 6 is a plan view of subassemblies of FIG. 5 as they would be joined to form a subfloor.

FIG. 7 is a sectioned elevation view of the anchor strips and clips of FIG. 5 as viewed along line 7—7

DETAILED DESCRIPTION OF THE INVENTION

Figure 1:
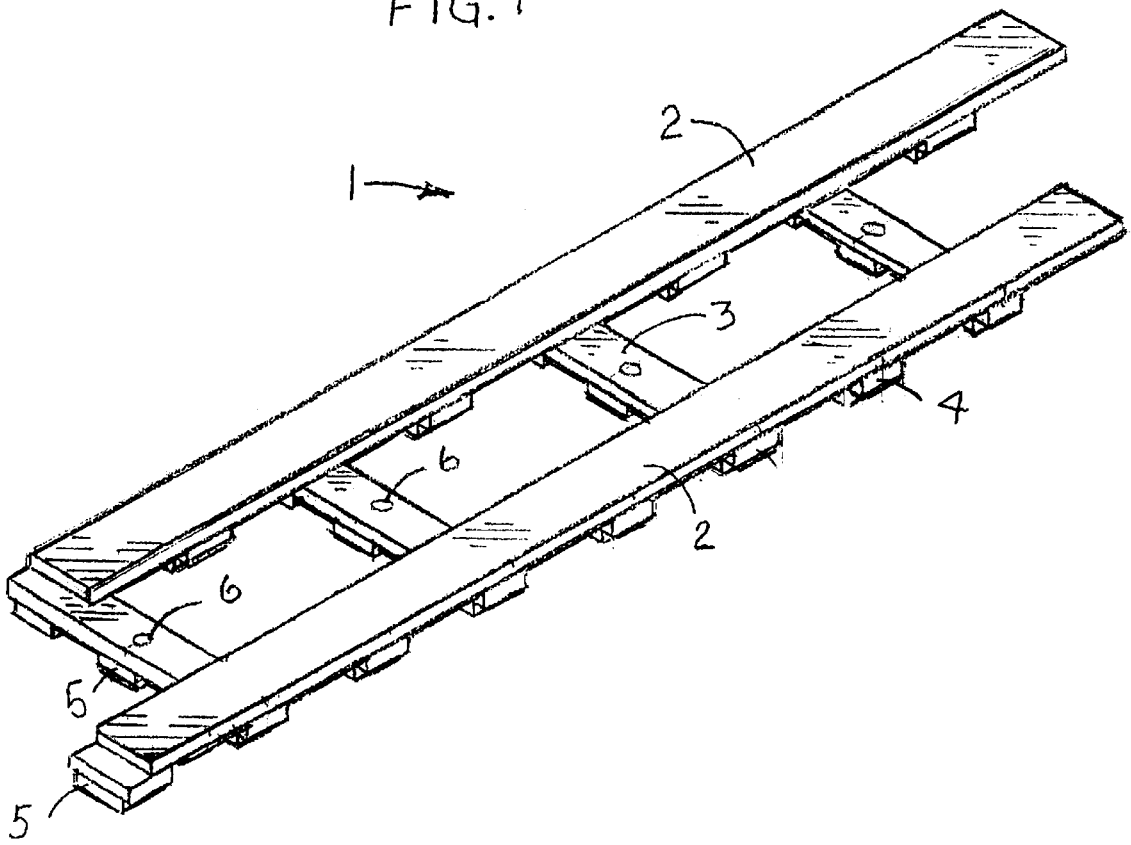
FIG. 1 is a pictorial view of a subflooring subassembly made according to this invention.

In the drawings, like numbers refer to like objects and the proportions of some components have been modified to facilitate illustration.

Referring now to FIGS. 1–4 wherein a preferred embodiment of the invention is shown. The concepts embodied in FIGS. 1–4 admit of numerous variants. Indeed, it is an object of this invention to provide a subfloor subassembly that can be modified to produce differing properties in a finished floor. The determining of the properties of the finished floor that will result from changes in configurations of components is in part science and in part art and at this stage dependent upon cut and try science to determine with certainty the outcome of modifications in a substructure.

Figure 2:
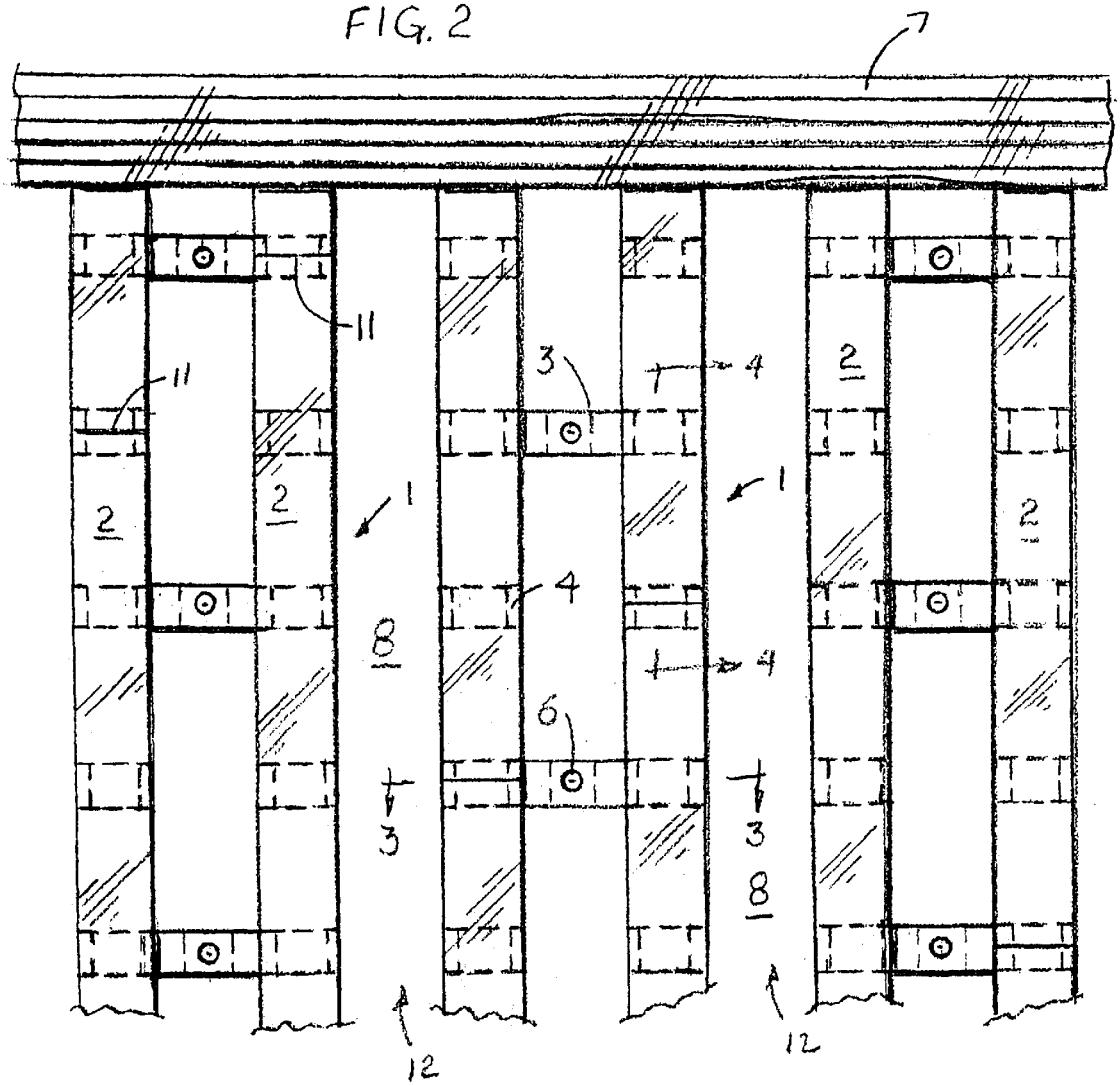
FIG. 2 is a plan view of subassemblies of FIG. 1 as they would be joined to form a subfloor.
Figure 3:
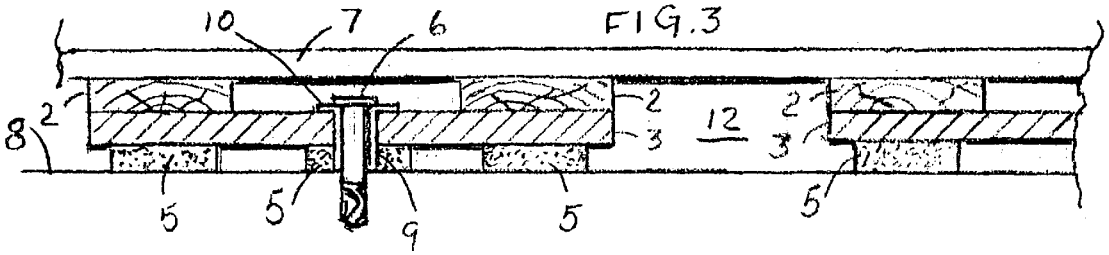
FIG. 3 is a sectioned elevation view of the anchor strip of the subassembly of FIGS. 1 and 2 taken along line 3—3 of FIG. 2

In this embodiment of the invention, subassembly 1 comprises longitudinal strips 2 having transverse anchor strips 3 and short pad strips 4 secured thereunder. Anchor strips 3 and pad strips 4 have resilient pads 5 secured thereunder. Anchor strips 3 are provided with anchors 6 as shown in FIGS. 1–3.

As best shown in FIG. 1, subassembly 1 is fashioned away from the installation site and can be rapidly installed at the job site by securing anchors 6 in place on anchor strips 3 to position sub assemblies 1 so that long strips 2 are parallel and spaced apart an equal distance. Finished floor 7 is then secured to long strips 2 to complete the athletic flooring structure ready for finishing.

The configurations of FIGS. 1 through 4 have aspects in common with other embodiments of this invention. Prefabricated subassembly 1 is formed using a minimal number of parts utilizing minimal amounts of materials to achieve the necessary structural properties needed to provide the finished floor with the attributes desired. Subassembly 1 is configured to be prefabricated, shipped, and installed readily and economically.

The attributes of a finished athletic floor are derived from complex interactions of all the components of the floor. A significant portion of the resilience of an athletic floor is derived from the properties and placement of the resilient components used while a significant portion of the flexibility of the floor is derived from the properties and distribution of the wood components of the floor.

Figure 4:
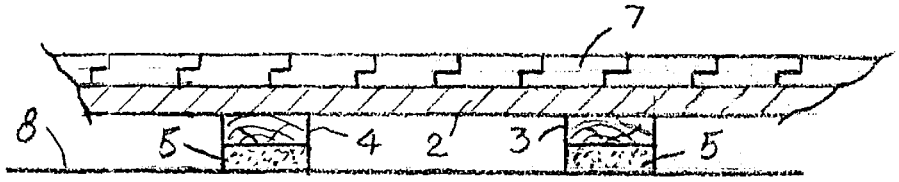
FIG. 4 is an elevation view showing the placement of anchor strips, spacer strips and resilient pads of the subassembly of FIGS. 1 and 2 taken along the line 4—4 of FIG. 2.

As can best be seen in FIGS. 3 and 4, a load placed on finished floor 7 will be transmitted downward onto long strips 2 and therefrom to one or more anchor strips 3 and/or pad strips 4 to resilient pads 5. As shown in FIG. 1, subassembly 1 provides for the regularly spaced placement of 16 pads 5. As can be seen in FIG. 2, a subfloor assembled of subassemblies 1 provides an arrangement of uniformly spaced pads 5 under the entire subfloor. As also can be seen in FIG. 2, long strips 2 are parallel and equally spaced and there is a space between subassemblies 1 that has no cross members. This provides one mode of reducing the material content of the subfloor while speeding the installation of the subfloor.

As can best be seen in FIG. 2, subassemblies 1 are laid so that their long strips 2 are parallel and spaced apart from the long strips 2 of adjacent subassemblies a distance approximately equal to the distance between long strips 2 of subassemblies 1. This creates open channels 12 wherein there are no substructure members between the base 8 and finished floor 7 which provides open channel 12 through which ventilating air can freely flow through the subfloor.

Long strip 2 in the embodiment of FIGS. 1–4 is three fourths of an inch thick, five and one half inches wide and eight feet long. In this embodiment long strips 2 are nailing strips and as such need to be thick enough to receive nails joining finished floor 7 to long strips 2 while still being flexible enough to permit the use of the boards without the need to interject transverse kerfs in order to obtain adequate flexibility as is often done in the prior art. Anchor strips 3 are three fourths of an inch thick and four inches wide and seventeen and one half inches long. Pad strips 4 are three fourths of an inch thick, four inches wide and five and one half inches long. Strips 2, 3, and 4 are typically of pine or fir. The thickness, and width of boards 2, 3, and 4 can range from a thickness of ⅜" to 1" and a width of from 1 ⅝" to a width of 8". It should be noted that nominal 1×2, 1×4, 1×6, and 1×8 boards are within the useful range of board sizes for practicing this invention. Where the sought after end results permit, the use of standard sized boards to form the wood strips of this invention contributes to the low cost of the subflooring assembly.

Pads 5 are ½" thick, 4" by 4" pads of natural rubber, neoprene, urethane foam or the like that are resilient and hydrophobic.

Anchors 6 as shown in FIG. 3 are expansion anchors that expand outward when driven into a drilled hole. Anchor 6 serves to secure sleeve 9 in place on base 8. The upward movement of anchor strip 3 is thereby limited. Floor 7 is then free to move downward on sleeve 9 until it contacts the top of anchor 6, and rebound upward until anchor strip 3 engages sleeve flange 10 of sleeve 9. The thickness pads 5 and the thickness of long strips 2 set the extreme limits of vertical travel of floor 7 but in practice an athletic floor is designed so that the total downward deflection of a floor loaded to capacity is in the range of ¾ the thickness of the pads. The designer designs the anchor, the sleeve, the pad, and the thickness of the long strip to provide clearance between the top of anchor 6 and the bottom of floor 7 that will accommodate travel equal to or greater than the thickness of the pads.

Subassemblies 1 of FIG. 2 are shown to have their long strips 2 abut each other at staggered locations 11 in the subfloor to form continuous parallel nailing strips that are equally spaced from each other throughout the subfloor. Pads 5 are equally spaced below strips 2 to provide a subfloor of uniform properties throughout with a minimum number of different structural members.

The end objective of this invention is to provide a versatile, low cost, easily and rapidly installed subfloor subassembly that will produce a superior athletic floor that is, ventilatable, anchored, resilient, and DIN certifiable.

The above disclosures are enabling and would permit one skilled in the art to make and use this invention for its intended purposes without undue experimentation. There are numerous variations of this invention, which preserve the inventive concept while permitting a range of design choice within the limitations of the appended claims.

Referring now to FIGS. 5–8, wherein a second preferred embodiment is shown and which serves to illustrate some of the variations of the invention.

Figure 8:
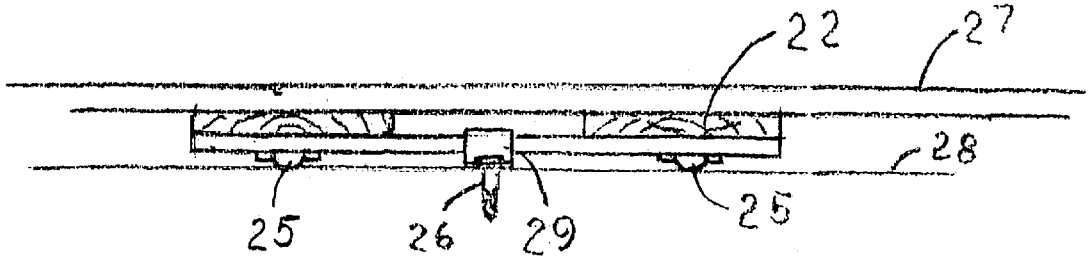
FIG. 8 is a sectioned elevation view showing the anchor, the clip and the pads as they relate to the anchor strips, the long strips, and the finished floor of FIG. 5.

In this embodiment of the invention, subassembly 21 comprises longitudinal strips 22 having transverse anchor strips 23 secured thereunder. Anchor strips 23 have resilient pads 25 secured thereunder. Anchor strips 23 are provided with anchors 26 as shown in FIGS. 6–8.

Figure 5:
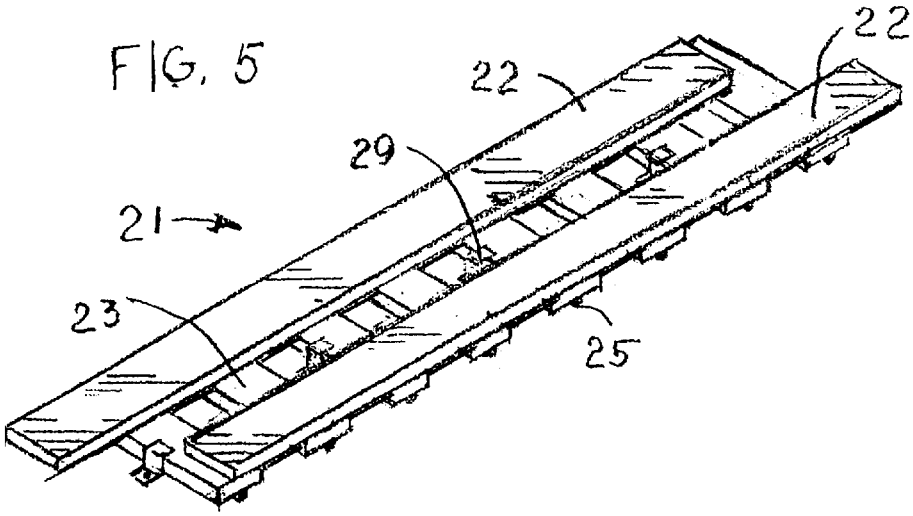
FIG. 5 is a pictorial view of second subflooring subassembly made according to this invention.

As best shown in FIG. 5, subassembly 21 is fashioned away from the installation site and can be rapidly installed at the job site by securing anchors 26 in place relative to anchor strips 23 to position sub assemblies 21 so that long strips 22 are parallel and spaced apart an equal distance. Finished floor 27 is then secured to long strips 22 to complete the athletic flooring structure ready for finishing.

As can best be seen in FIG. 6, subassemblies 21 are laid so that their long strips 22 are parallel and spaced apart from the long strips 22 of adjacent subassemblies a distance approximately equal to the distance between long strips 22 of subassemblies 21. This creates open channels 33 wherein there are no substructure members between the base 8 and finished floor 27 which provides open channels 33 through which ventilating air can freely flow through the subfloor.

The configurations of FIGS. 5 through 8 have aspects in common with other embodiments of this invention. Prefabricated subassembly 21 is formed using a minimal number of parts utilizing minimal amounts of materials to achieve the necessary structural properties needed to provide the finished floor with the attributes desired. Off the shelf standard sized components are used extensively. Subassembly 21 is configured to be prefabricated, shipped, and installed readily and economically.

In the embodiment of FIGS. 5–8, long strips 22 are nominal 1"×6" boards and anchor strips 26 are also nominal 1"×6" boards. The long strips 22 of subassemblies 21 are abutted at locations 31 on anchor strip 26 to form a subfloor assembly having continuously aligned long strips 22 evenly spaced apart as shown in FIG. 6. Alternatively, long strips 22 may be abutted on a long abutting strip 32 as shown dashed in FIG. 6. Anchor strips 22 are evenly spaced along long strips 22 so that in a completed subfloor the intersections between long strips 22 and anchor strips 26 are uniformly distributed beneath finished floor 27.

Resilient pads 25 are molded hemispherical pads with attachment strips as a part thereof and are well known in the art. Molded pads such as pads 25 lend themselves to machine attachment to subassembly 21. The size, shape, number, distribution, and composition of pads 25 have an appreciable effect on the measurable properties of an athletic floor supported thereby. The designer has great latitude in selecting and locating pads 25 and in selecting and positioning pads 25 on anchor strips 23 so that pads 25 are evenly distributed throughout a finished subfloor using subassemblies 21 of this invention.

In the embodiment of FIGS. 5–8, flanged anchoring clips 29 are provided. The anchoring of athletic flooring systems is common in the art. The two most common two means for anchoring such systems is by means of an anchor that passes through a component of the subfloor and the upward rebound of the floor is limited by the head of the anchor engaging a component of the subfloor and by means of a flanged means anchored to the base of the athletic floor and the flanged means has a horizontal flange that limits the upward rebound of the floor by engaging a component of the subfloor. Anchors 6 of FIGS. 1–4 are examples of the former, and anchors 26 of FIGS. 5–8 are examples of the latter.

As best seen in FIG. 6 anchors 29 are applied to some of the anchor strips, but not all. The uniform distribution of anchors 29 is here achieved by anchoring every other anchor strip on ladder-shaped subassemblies 21.

The two embodiments of the invention disclosed are enabling and would permit one skilled in the art to make and use the invention for its intended purposes without undue experimentation. It should be understood, however, that the scope of the invention should not be limited to the embodiments disclosed but the scope of the invention should only be limited by the appended claims and all equivalents thereto that would be made apparent to one skilled in the art.

What is claimed is:

1. An improved athletic flooring substructure of the type that is flexible, resilient, anchored, ventilateable, and DIN certifiable, wherein the improvement comprises;

a) a prefabricated ladder-shaped subfloor subassembly wherein, the long outside strips of the ladder-shape are boards having a maximum thickness of one inch and a minimum thickness of three eighths of an inch, b) a multiplicity of transverse anchor strips secured below the long strips, said anchor strips being formed of boards having a maximum thickness of one inch and a minimum thickness of three eighths of an inch, c) resilient pads formed of hydrophobic material secured to the bottom of the anchor strips, d) anchors engaged with the anchor strips and secured in a base so that the anchor strips are free to flex downward against the resilience of the pads while their upward flexure is restrained by the anchors, and e) the subassemblies are secured to the base so that their long strips are parallel and evenly spaced apart so as to create an open channel between subassemblies through which ventilating air can pass freely.

2. The substructure of claim 1 wherein the resilient pads are formed of a closed cell resilient foam of hydrophobic material.

3. The substructure of claim 1 wherein the resilient pads are formed in the shape of a hemisphere of resilient hydrophobic material.

4. The substructure of claim 1 wherein the anchor passes through a sleeve that passes through the anchor strip.

5. The substructure of claim 1 wherein the anchor secures a flanged anchoring clip to the base and the flanged anchoring clip has a part thereof a horizontal flange located over a part of the anchor strip so as to restrict upward movement of the anchor strip.

6. The substructure of claim 1 wherein an athletic floor assembled on said substructure is DIN certifiable.

7. The substructure of claim 1 wherein the long strips and the anchor strips are standard sized nominal one inch boards.

* * * * *